US006185831B1

(12) United States Patent
Pluciennik

(10) Patent No.: US 6,185,831 B1
(45) Date of Patent: Feb. 13, 2001

(54) PICTURE HANGING AID

(76) Inventor: Steven S. Pluciennik, P.O. Box 1960, Lake Arrowhead, CA (US) 92352-1960

( * ) Notice: Under 35 U.S.C. 154(b), the term of this patent shall be extended for 0 days.

(21) Appl. No.: 09/016,960

(22) Filed: Feb. 2, 1998

(51) Int. Cl.[7] ..... B25H 7/00
(52) U.S. Cl. ..... 33/613; 33/666
(58) Field of Search ..... 33/613, 645, 533, 33/644, 666, 677, 528

(56) References Cited

U.S. PATENT DOCUMENTS 3,516,165 * 6/1970 Pfeffer ..... 33/574
4,208,802 * 6/1980 Berndt ..... 33/347
4,228,982 * 10/1980 Sellera ..... 248/467
4,753,014 * 6/1988 Vrajich ..... 33/613
4,944,094 * 7/1990 Depiano ..... 33/371
5,109,611 * 5/1992 Houck ..... 33/613
5,129,154 * 7/1992 Aydelott ..... 33/613
5,471,760 * 12/1995 Farris ..... 33/613
5,867,917 * 2/1999 Karon ..... 33/613
6,000,142 * 12/1999 Deaton ..... 33/613

* cited by examiner

*Primary Examiner*—Andrew H. Hirshfeld
*Assistant Examiner*—R A Smith

(57) ABSTRACT

A picture hanging aid including generally rectangular mounting bracket that has a rear wall with a threaded opening therein, and a generally rectangular opening extending from a top wall to a bottom wall. A generally rectangular strip is provided and has an adhesive on a first side and a second side. The first side of the strip is adhered to the bottom wall of the mounting bracket. The second side of the strip is releasably coupled to a frame edge of a picture frame. Finally, an elongated L-shaped stem has an elongated member that is sized for adjustable placement within the rectangular opening of the mounting bracket when the mounting bracket is coupled with the picture frame. The elongated member is held within the rectangular opening by an adjustment screw positioned within the threaded opening of the mounting bracket.

9 Claims, 3 Drawing Sheets

PICTURE HANGING AID

BACKGROUND OF THE INVENTION

1. Field of the Invention

The present invention relates to a picture hanging aid and more particularly pertains to providing an easy to use apparatus that will mark the exact spot in the wall where the hanging device for a picture frame is to be placed.

2. Description of the Prior Art

The use of a picture frame hanging device is known in the prior art. More specifically, picture frame hanging devices heretofore devised and utilized for the purpose of hanging framed pictures from the wall are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,893,776 to Floyd discloses a picture hanging apparatus. U.S. Pat. No. 4,637,583 to Babitz discloses a device for positioning picture hangers on a wall surface. U.S. Pat. No. 4,473,957 to Faulkner discloses a device for locating a frame hanger. U.S. Pat. No. 4,382,337 to Bendick discloses a device for locating a suspension hook. U.S. Pat. No. 4,363,173 to Caldera discloses a bolt hole locating and marking tool. Lastly, U.S. Pat. No. 4,220,309 to Eisen and Kimmelman discloses a method and apparatus for positioning hanging devices on a wall.

In this respect, the picture hanging aid according to the present invention substantially departs from the conventional concepts and designs of the prior art, and in so doing provides an apparatus primarily developed for the purpose of providing an easy to use apparatus that will mark the exact spot in the wall where the hanging device for a picture frame is to be placed.

Therefore, it can be appreciated that there exists a continuing need for a new and improved picture hanging aid which can be used for providing an easy to use apparatus that will mark the exact spot in the wall where the hanging device for a picture frame is to be placed. In this regard, the present invention substantially fulfills this need.

SUMMARY OF THE INVENTION

In view of the foregoing disadvantages inherent in the known types of picture frame hanging devices now present in the prior art, the present invention provides an improved picture hanging aid. As such, the general purpose of the present invention, which will be described subsequently in greater detail, is to provide a new and improved picture hanging aid which has all the advantages of the prior art and none of the disadvantages.

To attain this, the present invention essentially comprises a generally rectangular mounting bracket. The mounting bracket has a pair of long walls, a pair of short walls, a top wall and a bottom wall. The pair of long walls form a rear wall and a front wall. The rear wall has a threaded opening. A generally rectangular opening extends from the top wall to the bottom wall.

Included is a generally rectangular strip that has an adhesive on a first side and a second side. The first side of the strip is adhered to the bottom wall of the mounting bracket. The strip has a pair of elongated end edges. One of the pair of elongated end edges is adjacent the front wall of the mounting bracket. The second side of the strip is releasably coupled to a frame edge of a picture frame and allows the rear wall to be flush with a front wall of the picture frame.

Lastly, an elongated L-shaped stem is provided and has an elongated member interconnected with a horizontal projection. The elongated member has an end edge. The horizontal projection has a pointed edge. The elongated member is sized for adjustable placement within the rectangular opening of the mounting bracket, when the mounting bracket is coupled with the picture frame. The elongated member is held within the rectangular opening by an adjustment screw positioned within the threaded opening of the mounting bracket. The elongated member, when extended from the mounting bracket, is juxtapose a rear wall of the picture frame for allowing the horizontal projection to project away from the picture frame.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved picture hanging aid which has all the advantages of the prior art picture frame hanging devices and none of the disadvantages.

It is another object of the present invention to provide a new and improved picture hanging aid which may be easily and efficiently manufactured and marketed.

It is a further object of the present invention to provide a new and improved picture hanging aid which is of a durable and reliable construction.

An even further object of the present invention is to provide a new and improved picture hanging aid which is susceptible of a low cost of manufacture with regard to both materials and labor, and which accordingly is then susceptible of low prices of sale to the consuming public, thereby making such Picture hanging aid economically available to the buying public.

Still yet another object of the present invention is to provide a new and improved picture hanging aid which provides in the apparatuses and methods of the prior art some of the advantages thereof, while simultaneously overcoming some of the disadvantages normally associated therewith.

Still another object of the present invention is to providing an easy to use apparatus that will mark the exact spot in the wall where the hanging device for a picture frame is to be placed.

Lastly, it is an object of the present invention to provide a new and improved generally rectangular mounting bracket that has a rear wall with a threaded opening therein, and a generally rectangular opening extending from a top wall to a bottom wall. A generally rectangular strip is provided and has an adhesive on a first side and a second side. The first side of the strip is adhered to the bottom wall of the mounting bracket. The second side of the strip is releasably coupled to a frame edge of a picture frame. Finally, an elongated L-shaped stem has an elongated member that is sized for adjustable placement within the rectangular opening of the mounting bracket when the mounting bracket is coupled with the picture frame. The elongated member is held within the rectangular opening by an adjustment screw positioned within the threaded opening of the mounting bracket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
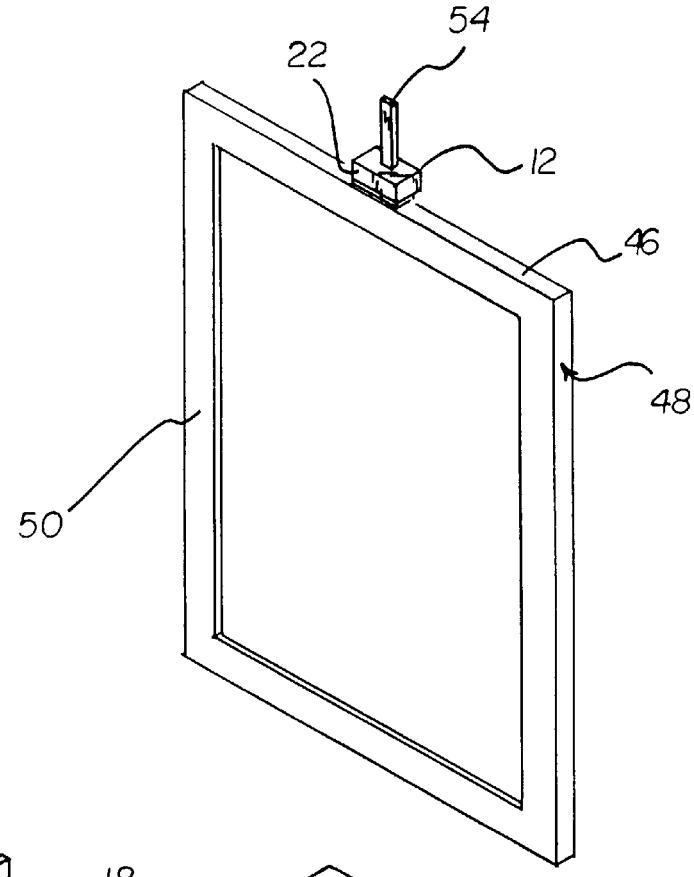
FIG. 1 is a perspective illustration of the preferred embodiment of the picture hanging aid constructed in accordance with the principles of the present invention.

With reference now to the drawings, and in particular to FIG. 1 thereof, a new and improved picture hanging aid embodying the principles and concepts of the present invention and generally designated by the reference numeral 10 will be described.

The present invention, the new and improved Picture hanging aid, is comprised of a plurality of components. Such components in their broadest context include mounting bracket and an L-shaped stem. Such components are individually configured and correlated with respect to each other so as to attain the desired objective.

Figure 5:
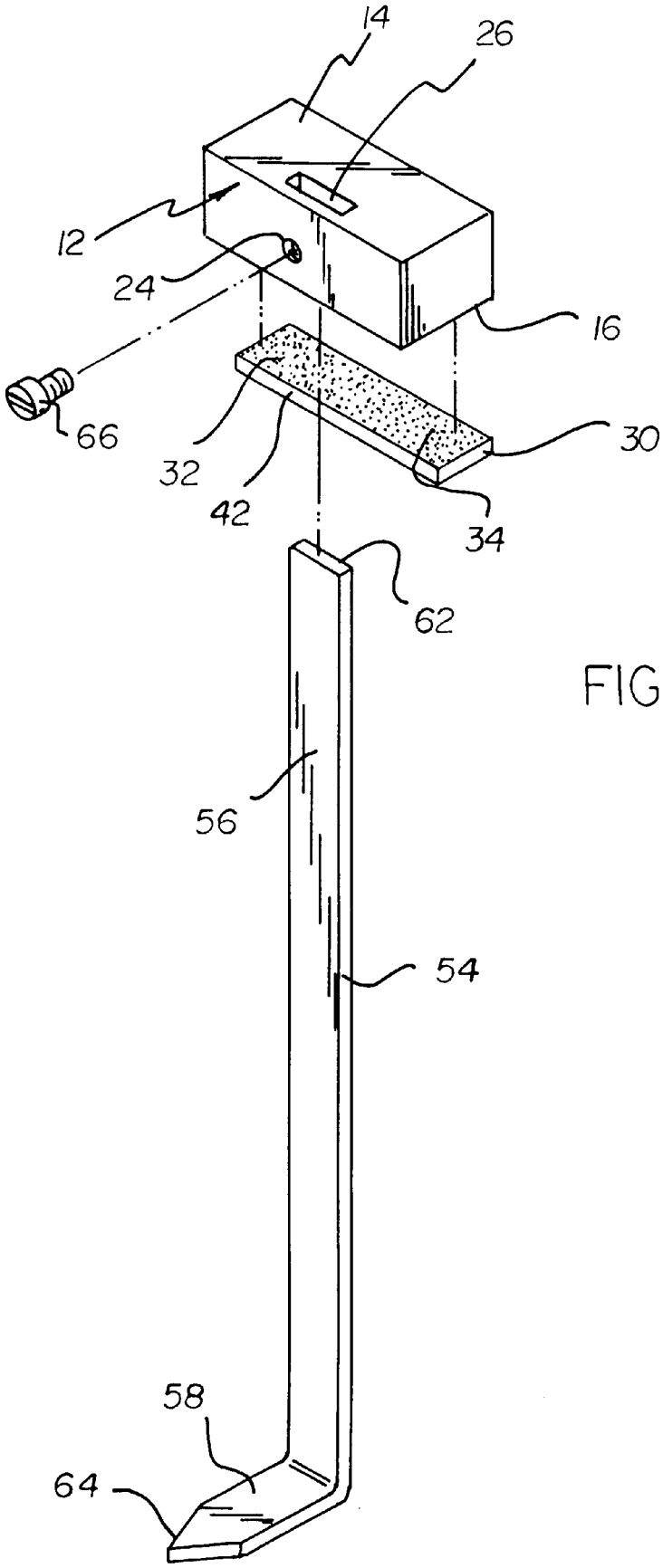
FIG. 5 is an exploded component view of the present invention.

More specifically, the present invention includes a generally rectangular mounting bracket 12. The mounting bracket has a pair of long walls, a pair of short walls, a top wall 14 and a bottom wall 16. The pair of long walls form a rear wall 18 and a front wall 22. The rear wall has a threaded opening 24. As shown in FIG. 5, included is a generally rectangular opening 26. The rectangular opening extends from the top wall to the bottom wall of the mounting bracket.

Figure 3:
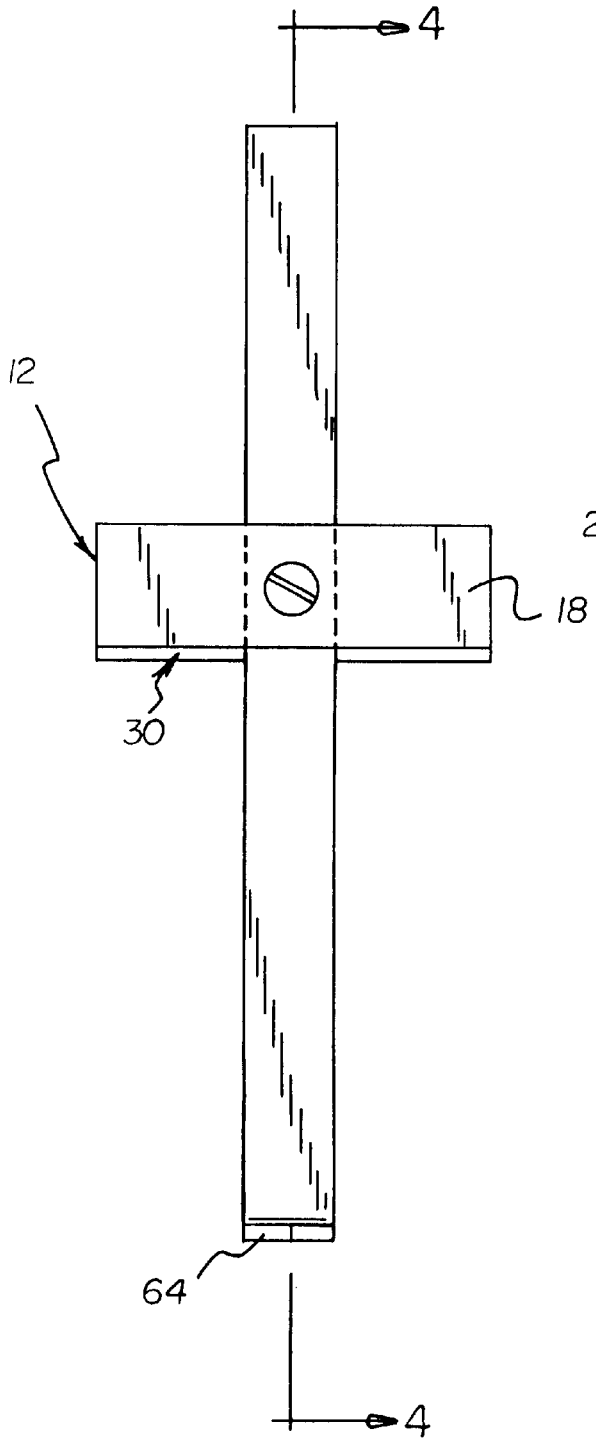
FIG. 3 is a frontal view of the present invention.
Figure 4:
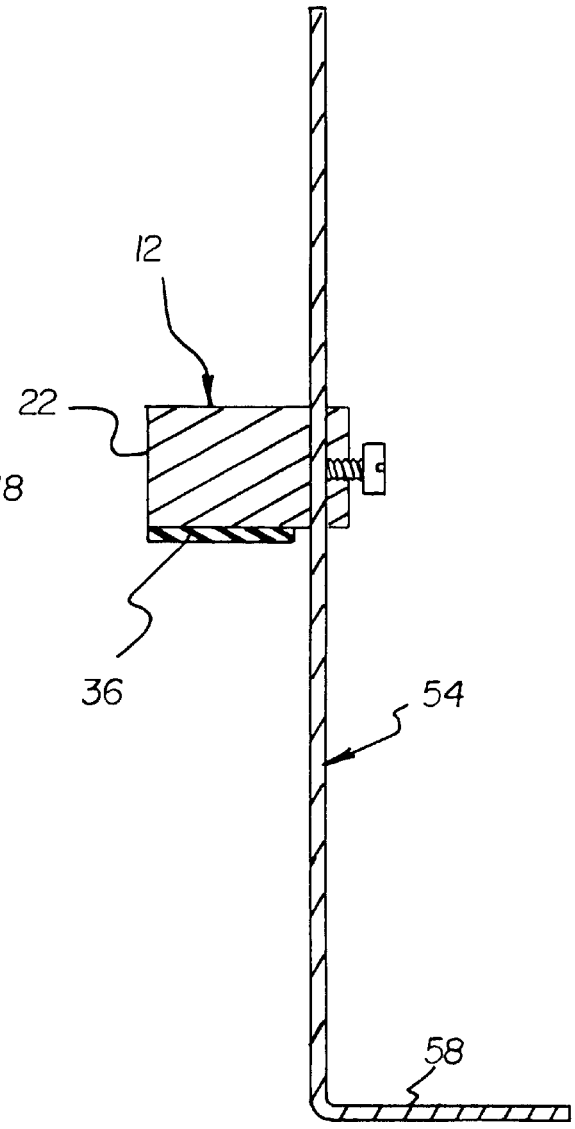
FIG. 4 is a cross-sectional side view of the present invention.

Included is a generally rectangular strip 30. The strip has an adhesive 32. The adhesive is on a first side 34 and a second side 36 of the strip. As illustrated in FIGS. 3 and 4, the first side of the strip is adhered to the bottom wall 16 of the mounting bracket. The strip has a pair of elongated end edges 42. FIG. 4 shows that one of the pair of elongated end edges is adjacent the front wall 22 of the mounting bracket. As seen in FIG. 1, the second side of the strip is releasably coupled to a frame edge 46 of a picture frame 48 and allows the rear wall to be flush with a front wall 50 of the picture frame.

Figure 2:
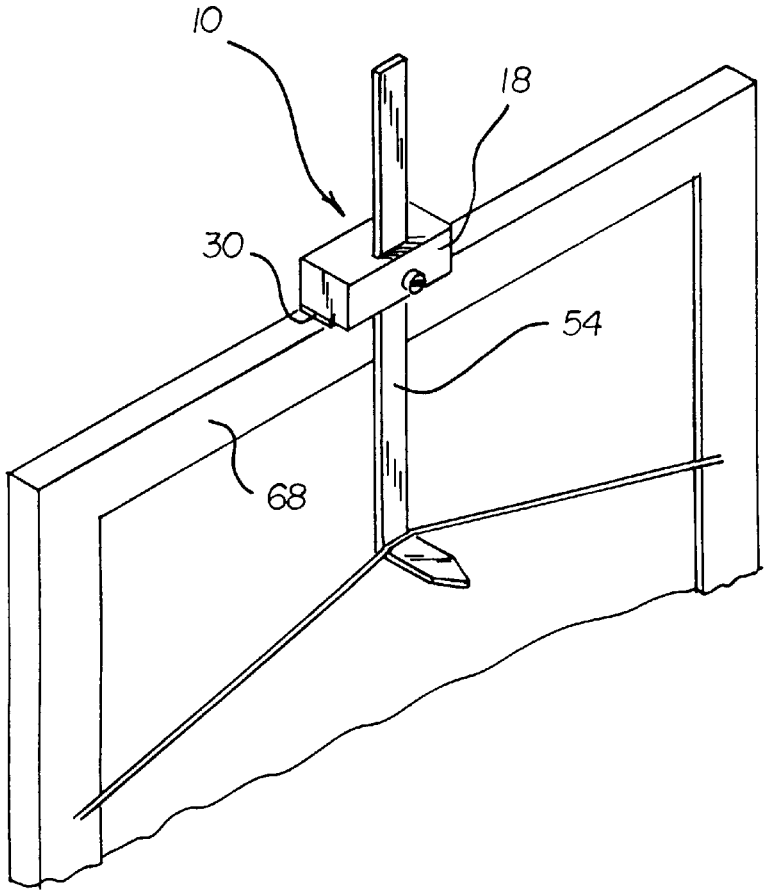
FIG. 2 is an isometric view of the present invention in an operable orientation.

Lastly, an elongated L-shaped stem 54 is provided. The stem has an elongated member 56 interconnected with a horizontal projection 58. The elongated member has an end edge 62. The horizontal projection has a pointed edge 64, as shown in FIG. 2. The elongated member is sized for adjustable placement within the rectangular opening of the mounting bracket, when the mounting bracket is coupled with the picture frame. The elongated member is held within the rectangular opening by an adjustment screw 66. The adjustment screw is positioned within the threaded opening of the mounting bracket. The adjustment screw allows the horizontal projection's distance from the frame edge to vary. The elongated member, when extended from the mounting bracket, is juxtapose a rear wall 68 of the picture frame for allowing the horizontal projection to project away from the picture frame.

The present invention picture hanging aid is a specialized picture hanging tool, made of metal, plastic, wood, or a combination of the three. It has an adjustable vertical stem. The stem slides up and down through the mounting bracket. The desired adjustment is made, the stem is screwed to the mounting bracket via a flat head rag screw. A sharp pointed edge of the horizontal projection is used a marking tip to make a small dimple when pressed against the wall, marking the exact spot where the nail or hanging device should go. A peel-off foam adhesive strip may be attached to the bottom wall of the mounting bracket. The strip keeps the mounting bracket in place while placing the picture frame next to the wall and marking the wall.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A picture hanging aid used to mark a wall for placement of a hanging device comprising, in combination:

a generally rectangular mounting bracket, the mounting bracket having a pair of long walls, a pair of short walls, a top wall and a bottom wall, the pair of long walls forming a rear wall and a front wall, the rear wall having a threaded opening therein, a generally rectangular opening extending therethrough from the top wall to the bottom wall;

a generally rectangular strip having an adhesive on a first side and an adhesive on a second side, the first side of the strip being adhered to the bottom wall of the mounting bracket, the strip having a pair of elongated end edges, one of the pair of elongated end edges being adjacent the front wall of the mounting bracket, the second side of the strip being for releasably coupling to a frame edge of a picture frame and allows the rear wall to be flush with a front wall of the picture frame; and an elongated L-shaped stem having an elongated member interconnected with a horizontal projection, the elongated member having an end edge, the horizontal projection having a pointed edge, the elongated member being sized for adjustable placement within the rectangular opening of the mounting bracket when the mounting bracket is to be coupled with the picture frame, the elongated member being held within the rectangular opening by an adjustment screw positioned within the threaded opening of the mounting bracket, the elongated member when extended from the mounting bracket for being juxtaposed on a rear wall of the picture frame for allowing the horizontal projection to project away from the picture frame.

2. A picture hanging aid comprising:

a generally rectangular mounting bracket having a rear wall with a threaded opening therein, and a generally rectangular opening extending therethrough from a top wall to a bottom wall;

a generally rectangular strip having an adhesive on a first side and an adhesive on a second side, the first side of the strip being adhered to the bottom wall of the counting bracket, the second side of the strip being for releasably coupling to a frame edge of a picture frame; and an elongated L-shaped stem having an elongated member being sized for adjustable placement within the rectangular opening of the mounting bracket when the mounting bracket is to be coupled with the picture frame, the elongated member being held within the rectangular opening by an adjustment screw positioned within the threaded opening of the mounting bracket.

3. The picture hanging aid as set forth in claim 2, wherein the mounting bracket includes a pair of long walls, a pair of short walls, the top wall and the bottom wall, and the pair of long walls forming the rear wall and the front wall.

4. The picture hanging aid as set forth in claim 2, wherein the elongated member is interconnected with a horizontal projection, the elongated member having an end edge, the horizontal projection having a pointed edge, and the elongated member when extended from the mounting bracket for being juxtaposed on a rear wall of the picture frame for allowing the horizontal projection to project away from the picture frame.

5. A tool for the positioning of picture frames or other objects on a wall and marking the position of a hanging device, said tool comprising:

an elongated L-shaped locating member consisting of a long arm which is adjustably positioned in a bracket and a short arm with a first purpose and a second purpose, the first purpose is served by a sharpened element at the terminus of the short arm for marking the exact position of the hanging device, and the second purpose is served by having the short arm sufficiently long to support a frame hanging wire;

the bracket possesses a means of adjustably locating the long arm of the locating member to it and a flat surface of sufficient dimension that is adapted to be placed on a top surface of an item to be hung, as the bracket is lowered onto, and held against the top surface of the item while the short arm of the locating member is adapted to be hooked under a hanging wire of the item and adjusted to apply sufficient tension to hold the bracket in place, said bracket possessing a rectangular strip adhered to the flat surface of the bracket, which allows protection of the top surface of the item to be hung and which assists in holding the bracket in place, said bracket includes a rear wall with a threaded opening therein and an opening extending from the top to the bottom to receive the long arm of the locating member.

6. The tool of claim 5 wherein the rectangular strip includes a non-slip lower surface.

7. The tool of claim 5 wherein the rectangular tool of claim 5 wherein the rectangular strip is adapted to deform to absorb the tension applied by hooking the short end of the locating member under the hanging wire of a the item and adjusting the long arm of the locating member within the bracket to hold the item in place.

8. The tool of claim 5 wherein the rectangular strip is adapted to adhere to the top surface of the item to be placed on a wall under the tension applied by hooking the short end of the locating member under the hanging wire of the item and adjusting the long arm of the locating member within the bracket to hold the item in place.

9. The tool of claim 5 and further including a hand adjustable screw and wherein the long arm of the locating member is held within the bracket by the hand adjustable screw.

* * * * *

UNITED STATES PATENT AND TRADEMARK OFFICE

CERTIFICATE OF CORRECTION

PATENT NO. : 6,185,831B1
DATED : February 13, 2001
INVENTOR(S) : Steven S. Pluciennik It is certified that error appears in the above-identified patent and that said Letters Patent is hereby corrected as shown below:

Title page,

Item [76], should read:

Steven S. Pluciennik, P.O. Box 2115,
Marco Island, FL 34146-2115

Signed and Sealed this

Fourteenth Day of August, 2001

*Attest:*

Nicholas P. Godici

*Attesting Officer*

NICHOLAS P. GODICI
*Acting Director of the United States Patent and Trademark Office*